US005109814A

United States Patent [19]

Coates

[11] Patent Number: 5,109,814

[45] Date of Patent: May 5, 1992

[54] SPHERICAL ROTARY VALVE

[76] Inventor: George J. Coates, 2500 Belmar Blvd., Wall Township, Belmar County, N.J. 07719

[21] Appl. No.: 697,981

[22] Filed: May 10, 1991

[51] Int. Cl.[5] ..... F01L 7/06

[52] U.S. Cl. ..... 123/190.14; 123/80 D; 123/190.1; 123/190.2

[58] Field of Search ..... 123/190 R, 190 A, 190 BD, 123/80 D, 80 R, 80 BA

[56] References Cited

U.S. PATENT DOCUMENTS

| | | | |
|---|---|---|---|
| 4,077,382 | 3/1978 | Gentile | 123/190 R |
| 4,821,692 | 4/1989 | Browne | 123/190 A |
| 4,944,261 | 7/1990 | Coates | 123/190 A |
| 4,953,527 | 9/1990 | Coates | 123/80 D |
| 4,976,232 | 12/1990 | Coates | 123/190 E |
| 4,989,558 | 2/1991 | Contes | 123/190 D |
| 4,989,576 | 2/1991 | Coates | 123/190 D |

*Primary Examiner*—E. Rollins Cross

*Assistant Examiner*—Erick Solis

*Attorney, Agent, or Firm*—Clifford G. Frayne

[57] ABSTRACT

An improved rotary valve for a spherical rotary valve engine in which the intake spherical valve and the exhaust spherical valve have an aperture on the spherical periphery for communication with the inlet port and exhaust port of the cylinder, respectively, the aperture having longitudinal parallel edges spaced apart a distance equivalent to the diameter of the inlet port or the exhaust port of the cylinder head, the lateral ends of the aperture on the spherical periphery of the intake and exhaust valve being curvalinear and of a semi-circular design, the semi-circular design conforming to the circumference of the inlet port and outlet port of the engine cylinder so as to provide for faster opening and faster closing of the intake port and exhaust port, respectively, and also providing a larger cross-sectional area more quickly in the opening phase and a reduction in the cross-sectional are a more quickly in the closing phase of the valve.

7 Claims, 6 Drawing Sheets

SPHERICAL ROTARY VALVE

FIELD OF INVENTION

This invention relates to an internal combustion engine of the piston and cylinder type, having a spherical rotary valve assembly or the introduction of the fuel/air mixture into the cylinder and the evacuation of exhaust gases, the improvement being directed to the porting on the spherical rotary valve and its cooperation with the inlet port and exhaust port of the cylinder.

BACKGROUND OF THE INVENTION

In an internal combustion engine of a piston and cylinder type, it is necessary to charge the cylinder with a fuel/air mixture for the combustion cycle and to vent or evacuate the exhaust gases at the exhaust cycle of each cylinder of the engine. In the conventional piston and cylinder type engine, these events occur thousands of times per minute per cylinder. In the conventional internal combustion engine, the rotation of a camshaft causes a spring-loaded valve to open to enable the fuel/air mixture to flow from the carburetor to the cylinder and the combustion chamber during the induction stroke. This camshaft closes this intake valve during the compression and combustion stroke of the cylinder and the same camshaft opens another spring-loaded valve, the exhaust valve, in order to evacuate the cylinder after compression and combustion have occurred. These exhaust gases exit the cylinder and enter the exhaust manifold.

The hardware associated with the efficient operation of conventional internal combustion engines having spring-loaded valves includes items such as springs, cotters, guides, rockers, shafts and the valves themselves which are usually positioned in the cylinder heads such that they normally operate in a substantially vertical position, with their opening, descending into the cylinder for the introduction or venting or evacuation of gases.

As the revolution of the engine increases, the valves open and close more frequently and the timing and tolerances become critical in order to prevent the inadvertent contact of the piston with an open valve which can cause serious engine damage. With respect to the aforementioned hardware and operation, it is normal practice for each cylinder to have one exhaust valve and one intake valve with the associated hardware mentioned heretofore; however, many internal combustion engines have now progressed to multiple valve systems, each having the associated hardware and multiple camshafts.

In the standard internal combustion engine, the camshaft is rotated by the crankshaft by means of a timing belt or chain. The operation of this camshaft and the associated valves operated by the camshaft presents the opportunity to decrease the engine efficiency to the friction associated with the operation of the various elements. Applicant's invention is directed towards a novel valve means which eliminates the need for spring-loaded valves and the associated hardware and in its simplest explanation, enlarges the camshaft to provide for spherical rotary valves to feed each cylinder. This decreases the number of moving parts and hence the friction involved in the operation of the engine and increases engine efficiency. It also eliminates the possibility of the piston contacting an open valve and thus causing serious engine damage.

Applicant's spherical rotary valve assembly in certain improvements and embodiments thereof are described in U.S. Pat. Nos. 4,953,527, 4,976,232, 4,944,261, 4,989,558 and 4,989,576. Applicant's spherical rotary valve assembly as described in the aforementioned patents eliminates the problems associated with the poppet valve assembly previously discussed.

Applicant's present invention based on the spherical rotary valve assembly relates to the porting of the intake and exhaust spherical rotary valves and the cooperation of this porting with the inlet port and exhaust port, respectively, of the cylinder head to provide for faster opening and faster closing of the inlet port and exhaust port of the cylinder head, respectively, thus providing a larger cross-sectional area more quickly in the opening phase and a reduction in the cross-sectional area more quickly in the closing phase of the valve.

OBJECTS OF THE INVENTION

An object of the present invention is to provide for a novel and unique spherical rotary valve for internal combustion engines which improves the breathing of the internal combustion engine.

Another object of the present invention is to provide a novel and unique spherical rotary valve for an internal combustion engine which increases the efficiency of the engine.

Another object of the present invention is to provide a novel and unique spherical rotary valve for an internal combustion engine which increases the inlet efficiency of the intake spherical rotary valve.

A still further object of the present invention is to provide for a novel spherical rotary valve for an internal combustion engine which increases the exhaust efficiency of the exhaust spherical rotary valve.

A still further object of the present invention is to provide for a novel and unique spherical rotary valve for an internal combustion engine which allows optimum valve timing for the reduction of emissions.

A still further object of the present invention is to provide for a novel and unique spherical rotary valve for an internal combustion engine which allows for the optimum timing to achieve maximum brake horsepower from the internal combustion engine.

SUMMARY OF THE INVENTION

An improved rotary valve for a spherical rotary valve engine in which the intake valve and exhaust valve are of a spherical design having an aperture on the spherical periphery for communication with the inlet port and exhaust port of the cylinder, the apertures on the spherical periphery of the respective valves having longitudinal, parallel edges spaced apart a distance equivalent to the diameter of the inlet port of exhaust port of the cylinder, the ends of the apertures on the spherical periphery of the intake valve and exhaust valve being curvalinear and of a semi-circular design, the semi-circular design conforming to the circumference of the inlet port and exhaust port of the engine cylinder so as to provide for faster opening and faster closing of the inlet port and exhaust port, respectively and thus providing a larger cross-sectional area more quickly in the opening phase and a reduction of the cross-sectional area more quickly in the closing phase of the valve.

BRIEF DESCRIPTION OF THE DRAWINGS

These and other objects of the present invention will be apparent particularly when taken in light of the detailed drawings wherein.

DETAILED DESCRIPTION OF THE DRAWINGS

Figure 1:
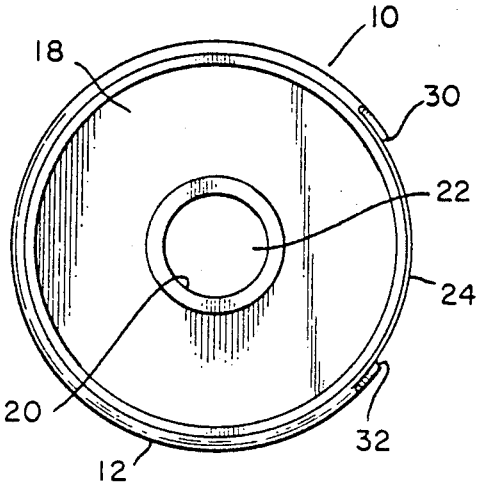
FIG. 1 is a side elevational view of an intake spherical rotary valve having a single port for use on an internal combustion engine when the valve mechanism operates at one-half the speed of the crankshaft.
Figure 2:
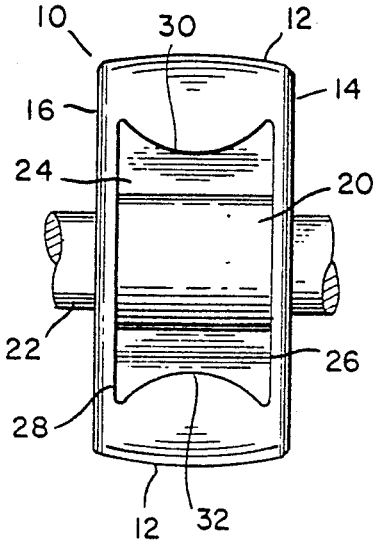
FIG. 2 is an end elevational view of an intake spherical rotary valve as illustrated in FIG. 1.

Considering FIGS. 1 and 2, there is illustrated a side elevational view and an end elevational view of the intake spherical rotary valve drum 10. Intake spherical rotary valve drum 10 is defined by an arcuate spherical circumferential periphery 12 and planer opposing sidewalls 14 and 16. Centrally disposed inwardly from planer sidewall 16 is an annular U-shape doughnut cavity 18 which extends from planer sidewall 16 to a depth approximate to planer sidewall 14, the corners and edges of U-shaped cavity 18 are preferably machined such that they are rounded.

There is centrally disposed through intake spherical drum 10, a central aperture 20 extending from planer sidewall 16 through planer sidewall 14, aperture 20 being centrally disposed through intake spherical drum 10 so as to provide a means for mounting intake spherical drum 10 on centrally-disposed shaft 22 to provide for the rotational disposition of intake spherical drum 10 as further described hereafter.

Passing through arcuate spherical circumferential periphery 12 and providing communication with annular U-shaped or doughnut cavity 18 is an intake aperture 24. Intake aperture 24 is elongated having parallel disposed sidewalls 26 and 28 and opposing arcuate end walls 30 and 32. Arcuate end walls 30 and 32 are defined by the arc of a circle, the radius of arcuate end walls 30 and 32 being substantially equal to the radius of the inlet port to the cylinder as discussed hereafter.

The intake spherical rotary valve drum 10 as illustrated in FIGS. 1 and 2 contains one aperture 24 in its periphery, communicating with U-shaped doughnut cavity 18. This configuration is utilized in internal combustion engines in which the valve mechanism of the engine rotates at one-half the speed of the crankshaft. Therefore, the aperture 24 and the spherical circumferential periphery of intake rotary valve drum 10 will come into communication with the inlet port of the cylinder once every revolution of intake spherical rotary valve drum 10.

Figure 3:
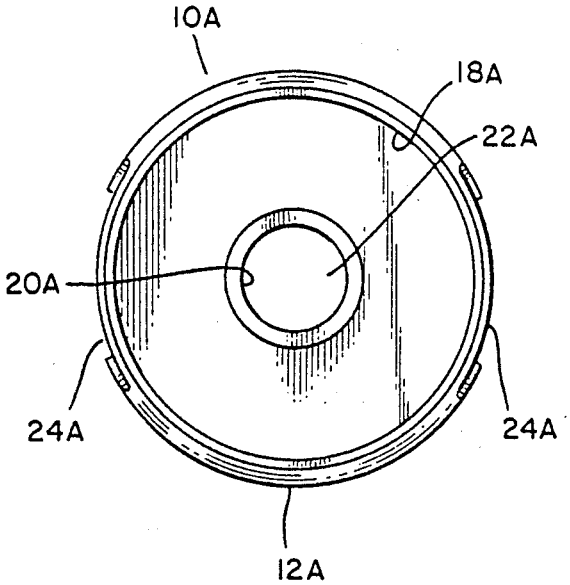
FIG. 3 is a side elevational view of an intake spherical rotary valve for use in an internal combustion engine when the valve mechanism operates at one-quarter the speed of the crankshaft.
Figure 4:
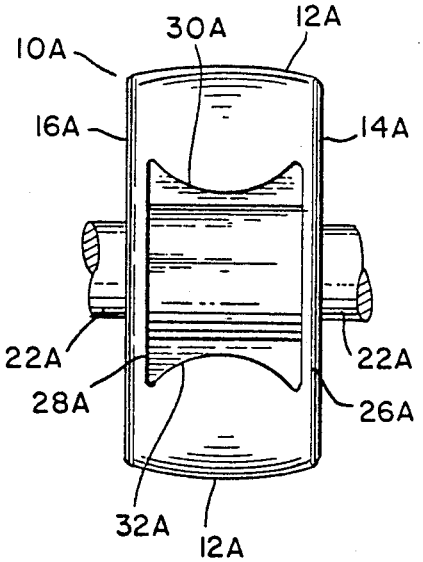
FIG. 4 is an end elevational view of an intake spherical rotary valve as illustrated in FIG. 3.

FIGS. 3 and 4 illustrate a side elevational view and an end elevational view of an intake spherical rotary valve drum 10A, designed to rotate at one-quarter the speed of the engine crankshaft. Intake spherical rotary valve drum 10A is substantially identical to intake spherical rotary valve drum 10 with respect to its spherical circumferential periphery 12A, U-shaped doughnut 16A, and sidewalls 14A and 16A. Intake spherical rotary valve drum 10A also has a central aperture 20A to provide for the positioning of intake spherical rotary valve drum 10A on a centrally-disposed shaft 22A as discussed hereafter. The difference between an intake spherical rotary valve drum 10 and intake spherical rotary valve drum 10A is that intake spherical rotary valve drum 10A has two apertures 24A positioned on its spherical periphery. Apertures 24A have parallel sidewalls 26A and 28A and arcuate end walls 30A and 32A, again with end walls 30A and 32A being semi-circular, their radius being substantially identical to the radius of the inlet port to the cylinder. There being two apertures 28A on intake spherical rotary valve drum 10A permits intake spherical rotary valve drum 10A to rotate and operate at one-quarter the speed of the engine crankshaft, apertures 24A being disposed 180° from each other on spherical periphery 12A as discussed hereafter.

Figure 5:
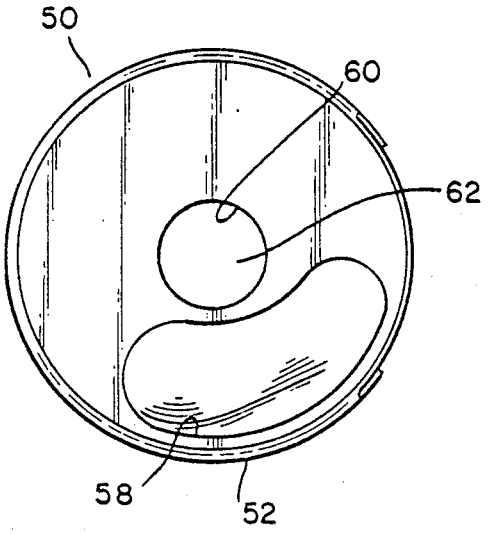
FIG. 5 is a side elevational view of an exhaust spherical rotary valve for use in an internal combustion engine in which the valve mechanism operates at one-half the speed of the crankshaft.
Figure 6:
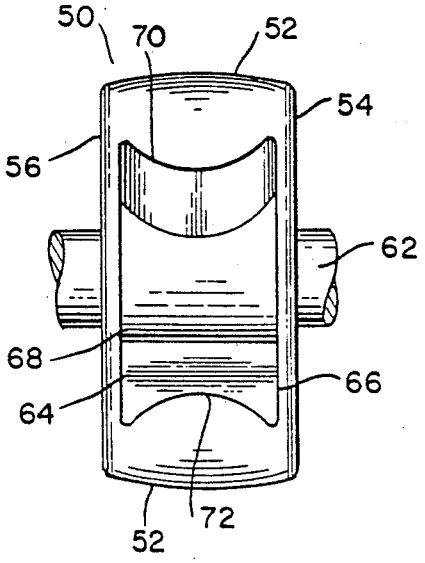
FIG. 6 is an end elevational view of an exhaust spherical rotary valve as illustrated in FIG. 5.

Referring to FIGS. 5 and 6, there is illustrated an end elevational view and a side elevational view of an exhaust spherical rotary valve drum 50. Exhaust spherical rotary valve drum 50 is defined by an arcuate spherical circumferential periphery 52 and planer opposing sidewalls 54 and 56. Disposed on planer sidewall 56 is an opening 58 which in the embodiment disclosed in FIG. 5 is kidney shaped..

There is centrally disposed through exhaust spherical drum 50 a central aperture 60 extending from planer sidewall 56 through planer sidewall 4, aperture 60 being centrally disposed through exhaust spherical drum 50 so as to provide a means for mounting exhaust spherical drum 50 on a centrally-disposed shaft 62 to provide for the rotational disposition of exhaust spherical rotary drum 50 as further described hereafter.

Passing through arcuate spherical circumferential periphery 52 and providing communication with kidney-shaped opening 58 is an exhaust aperture 64. Exhaust aperture 64 is elongated having parallel disposed sidewalls 66 and 68 and opposing arcuate end walls 70 and 72. Arcuate end walls 70 and 72 are defined by the arc of a circle, the radius of the arcuate end walls 70 and 72 being substantially equal to the radius of the exhaust port of the cylinder as discussed hereafter.

The exhaust spherical rotary valve drum 50 as illustrated in FIGS. 5 and 6 contains one aperture 64 in its spherical periphery 52 communicating with one kidney-shaped opening 58 in sidewall 56. This configuration is utilized in internal combustion engines in which the valve mechanism of the engine rotates at one-half the speed of the crankshaft. Therefore, the aperture 64 on spherical circumferential periphery of exhaust rotary valve drum 50 will come into communication with the exhaust port of the cylinder once every revolution of exhaust spherical rotary valve drum 50.

Figure 7:
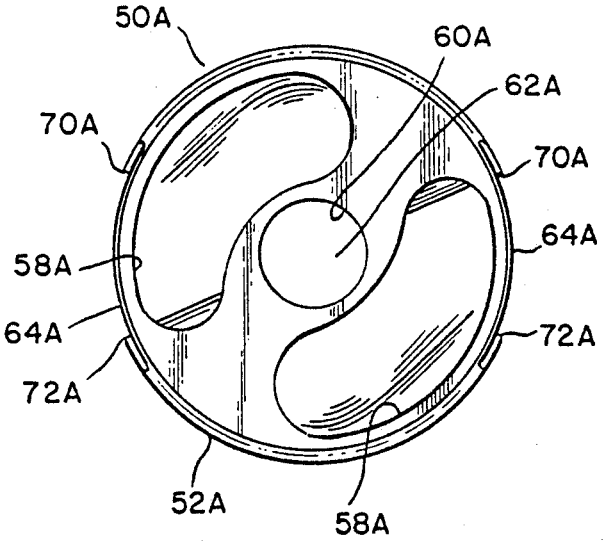
FIG. 7 is a side elevational view of an exhaust spherical rotary valve for use in an internal combustion engine when the valve mechanism operates at one-quarter the speed of the crankshaft.
Figure 8:
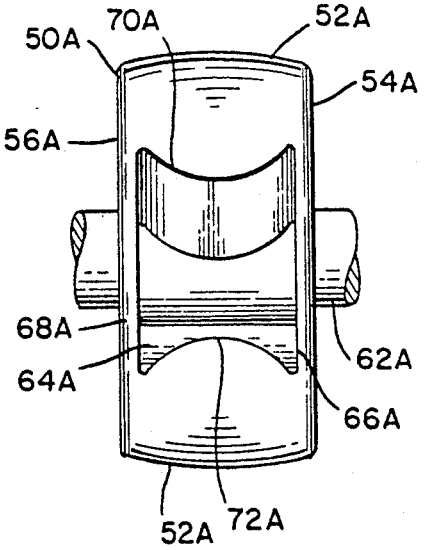
FIG. 8 is an end elevational view of an exhaust spherical rotary valve as illustrated in FIG. 7.

FIGS. 7 and 8 illustrate a side elevational view and an end elevational view of an exhaust spherical rotary valve drum 50A designed to rotate at one-quarter the speed of the engine crankshaft. Exhaust spherical rotary valve drum 50A is substantially identical to exhaust spherical rotary valve drum 50 with respect to its spherical circumferential periphery 52A, kidney-shaped opening 58A and sidewalls 54A and 56A. Exhaust spherical rotary valve drum 50A also has a central aperture 60A to provide for the positioning of exhaust spherical rotary valve drum 50A on a centrally-disposed shaft 62A. The difference between exhaust spherical rotary valve drum 50 and exhaust spherical rotary valve drum 50A is that exhaust spherical rotary valve drum 50A has two apertures 64A positioned on its spherical periphery and two kidney-shaped apertures 58A positioned on sidewall 56A, one periphery aperture communicating with one kidney-shaped aperture, respectively. Apertures 64A have parallel sidewalls 66A and 68A and arcuate end walls 70A and 72A again with end walls 70A and 72A being semi-circular, their radius being substantially identical to the radius of the exhaust port of the cylinder. There being two apertures 58A and two apertures 64A on exhaust spherical rotary valve drum 50A disposed 180° from each other respectively permits exhaust spherical rotary valve drum 50A to rotate and operate at one-quarter the speed of the engine crankshaft as discussed hereafter.

Figure 9:
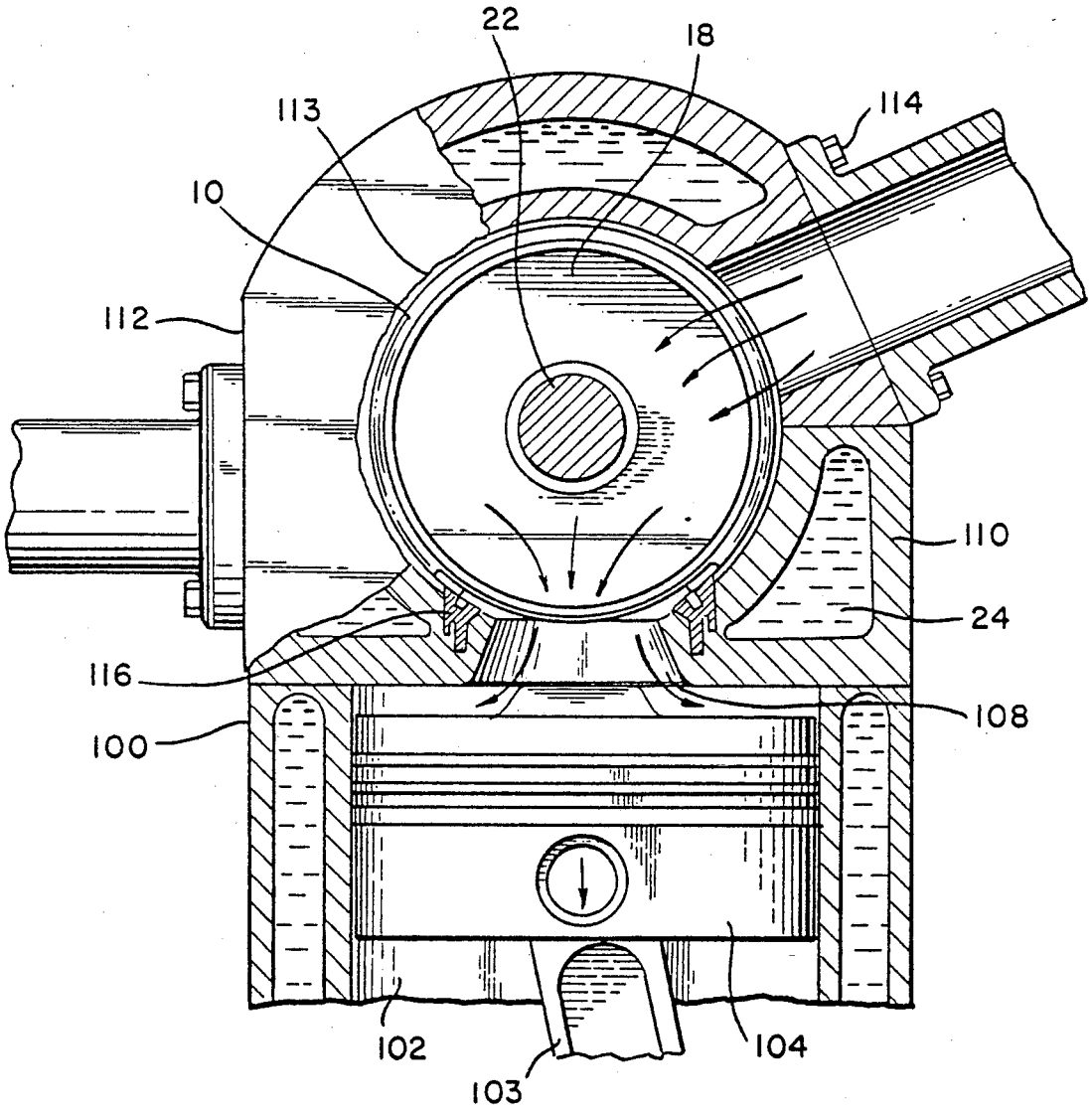
FIG. 9 is a side cross-sectional view of the intake spherical rotary valve mounted in a cylinder head.

FIG. 9 illustrates a side cross-sectional view of an intake spherical drum 10 positioned on an engine block 100 having disposed therein, a cylinder cavity 102 there being positioned within cylinder cavity 102, a reciprocating piston 104 secured to a crankshaft arm 103 which reciprocates within cylinder cavity 102. Applicant's intake spherical drum 10 is secured within a split head comprising a first lower section 110 which is secured to engine block 100 and which has positioned therein an intake port 108 in communication with cylinder cavity 102. The upper portion 112 of the split head when secured to lower portion 110 defines a drum accommodating cavity 113 for intake spherical drum 10. When upper half 112 and lower half 110 of the split head are secured to the engine block, intake spherical drum 10 is rotationally encapsulated within the cavity defined by the two halves of the split head assembly.

U-shaped or doughnut cavity 18 on intake spherical drum 10 is continually charged with a fuel/air mixture through inlet port 114, and this fuel/air mixture is introduced into cylinder cavity 102 through inlet port 108 when intake aperture 24 comes into rotational alignment with inlet port 108. A sealing mechanism 116 cooperates with the arcuate circumferential periphery 12 of intake spherical drum 10 to provide an effective gas-tight seal to ensure the fuel/air mixture passes from U-shaped or doughnut cavity 18 through inlet port 108 and into cylinder cavity 102.

In normal operation, this introduction of fuel/air mixture occurs with the downward movement of piston 104 during the intake stroke, thus charging the cylinder with fuel/air mixture. As soon as the inlet aperture 24 has been closed such that it is no longer in alignment with inlet port 108, the arcuate spherical circumferential periphery 12 of intake spherical drum 10 would seal the inlet port in preparation for the power stroke of piston 104 and the ignition of the fuel/air mixture. The rotation of intake spherical drum 10 on shaft 22, and all subsequent pairs of intake spherical drum 10 and exhaust spherical drum 50, which would be mounted on shaft 22, would be by means of a timing chain or other similar device in communication with the crankshaft, thus permitting the selective timing of the opening and closing of inlet port 108.

Figure 10:
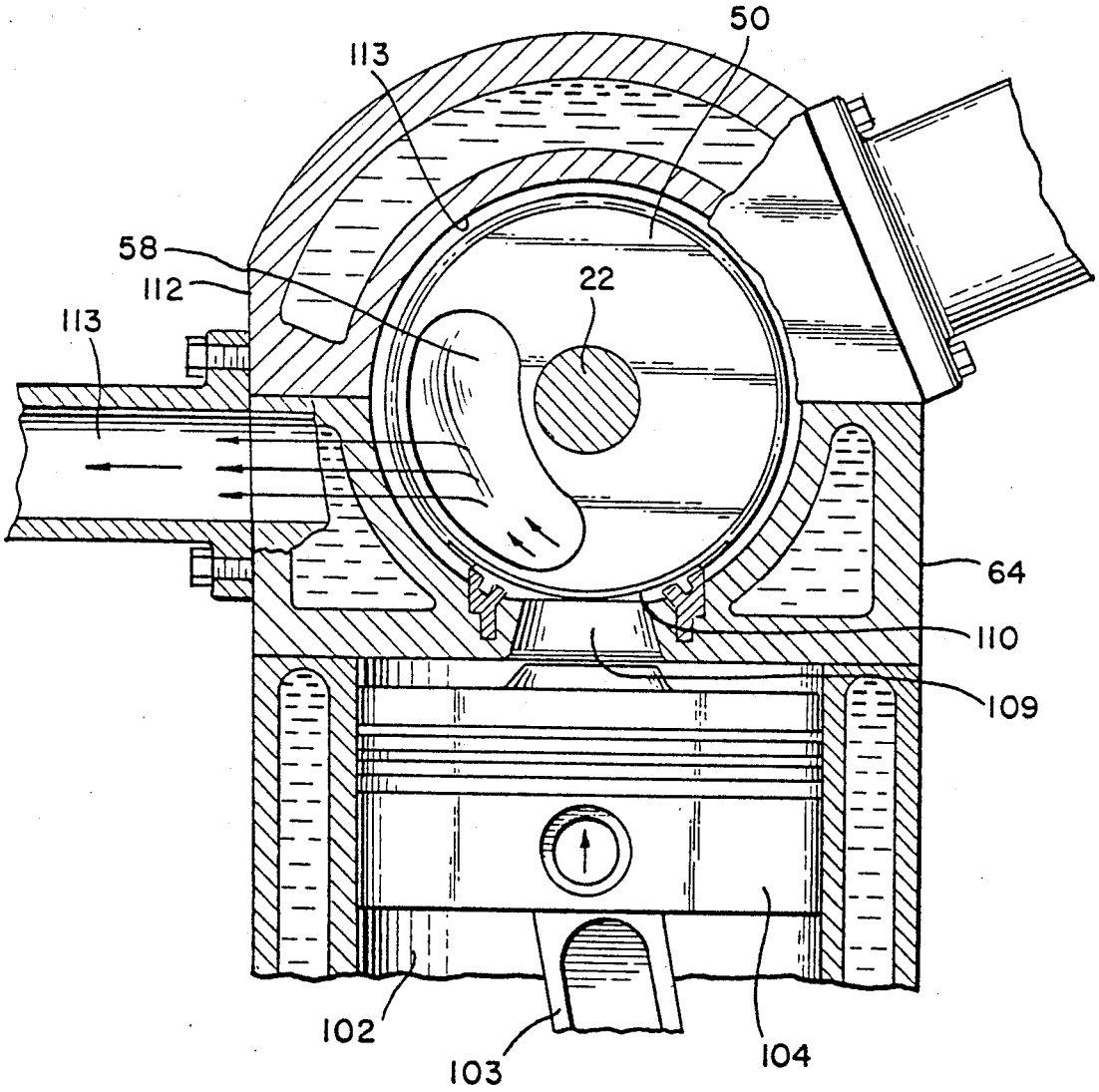
FIG. 10 is a side cross-sectional view of an exhaust spherical rotary valve mounted in a cylinder head.

FIGS. 11A, 11B, 11C, 11D and 11E are partial, top, cross-sectional views of intake spherical drum 10 along plane 11—11 of FIG. 10. FIGS. 11A, 11B, 11C, 11D and 11E illustrate the cooperation between intake spherical drum 10 and inlet port 108 and, in particular, the cooperation between intake aperture 24 on the spherical periphery 12 of intake spherical drum 10 and its cooperation with inlet port 108.

Figures 11A, 11B, 11C, 11D, 11E:
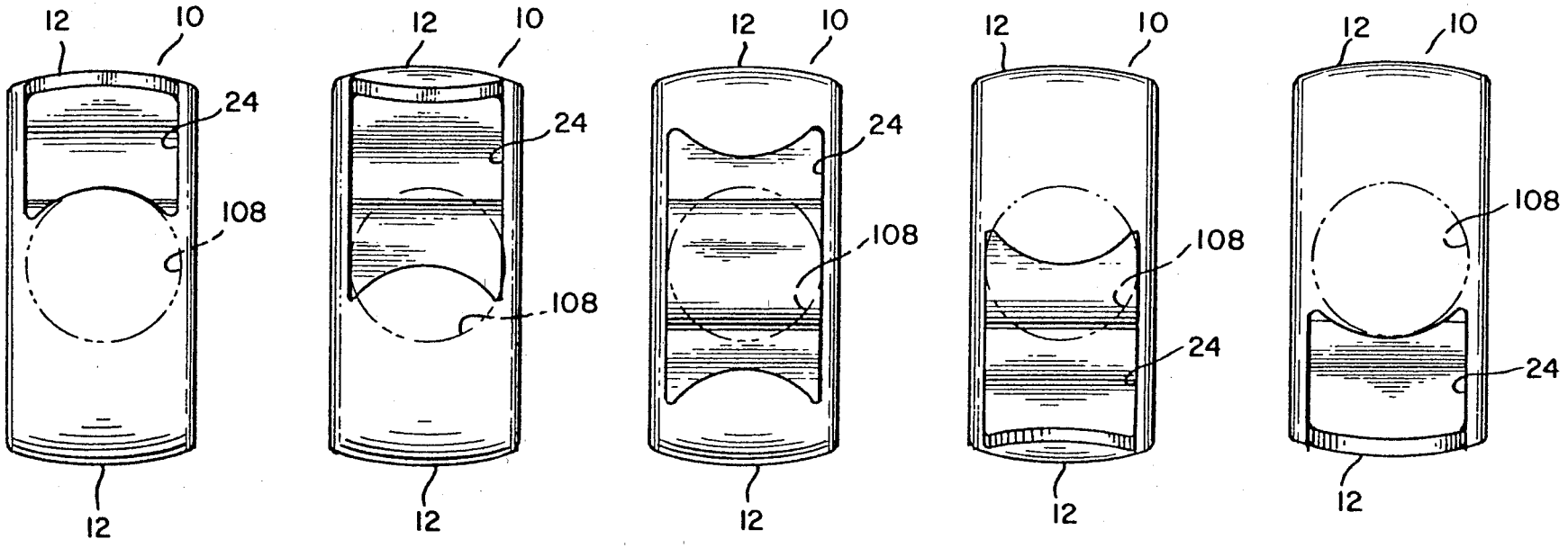
FIG. 11A is a top, partial sectional view of an intake spherical rotary valve along plane 11—11 of FIG. 9, illustrating the cooperation between the intake spherical valve and the cylinder head inlet port for opening and closing the inlet port.
FIG. 11B is a top, partial sectional view of an intake spherical rotary valve along plane 11—11 of FIG. 9, illustrating the cooperation between the intake spherical valve and the cylinder head inlet port for opening and closing the inlet port.
FIG. 11C is an end elevational view of an intake spherical rotary valve illustrating the cooperation between the valve and the cylinder head inlet port for opening and closing the inlet port.
FIG. 11D is an end elevational view of an intake spherical rotary valve illustrating the cooperation between the valve and the cylinder head inlet port for opening and closing the inlet port.
FIG. 11E is an end elevational view of an intake spherical rotary valve illustrating the cooperation between the valve and the cylinder head inlet port for opening and closing the inlet port.

FIG. 11A illustrates intake spherical drum 10 positioned in a sealing mode with respect to inlet port 108 of cylinder cavity 102. The spherical periphery 12 of intake spherical drum 10 in cooperation with sealing means 16 has secured the inlet port 108 in a closed position.

FIG. 11B illustrates the cooperation between arcuate end 32 of aperture 24 on intake spherical drum 10 and inlet port 108 of cylinder cavity 102. In this configuration, the opening of the inlet port is commenced and greater cross-sectional area is available quicker for the introduction of the fuel/air mixture. This rotation of intake spherical drum 10 and the opening of inlet port 108 continues until as illustrated in FIG. 11C, aperture 24 fully cooperates with inlet port 108 to permit unobstructed passage of fuel/air mixture from U-shaped doughnut cavity 18 into cylinder cavity 102. The further rotation of intake spherical drum 10 commences the closing of inlet port 108, FIG. 11D, which decreases the cross-sectional area available for the passage of the fuel/air mixture more quickly thus providing for a quicker closing, FIG. 11E, which allows a greater degree of flexibility in the timing of the engine.

FIG. 10 is a side cross-sectional view of an exhaust spherical drum 50 mounted on a cylinder head identical to that disclosed in FIG. 9, except that exhaust spherical drum 50 provides communication from cylinder cavity 102 by.means of exhaust port 109 to permit the passage of spent gases to exhaust manifold 113.

In operation, an intake spherical drum 10 would be paired with an exhaust spherical drum 50 on shaft 22, one intake and one exhaust spherical drum being positioned to provide intake and exhaust capability to each cylinder cavity 102. The performance of the exhaust spherical drum 50 would be identical to the performance of intake spherical drum 10 as illustrated in FIGS. 11A through 11E. However, instead of introducing a fuel/air mixture, aperture 64 on exhaust spherical drum 50 would cooperate with exhaust port 109 to evacuate the spent gases from cylinder cavity 102 through kidney-shaped opening 58 in sidewall 56 of exhaust spherical drum 50 and thence to the exhaust manifold 113. Aperture 64 would cooperate with exhaust port 109 of cylinder cavity 102 to again provide a greater cross-sectional area for the evacuation of spent gases more quickly and to cause the reduction of the cross-sectional area for the evacuation of spent gases more quickly in closing and sealing exhaust spherical drum 50 in cooperation with exhaust port 109 to again aid in the greater flexibility of establishing a timing for the engine.

Figure 12A:
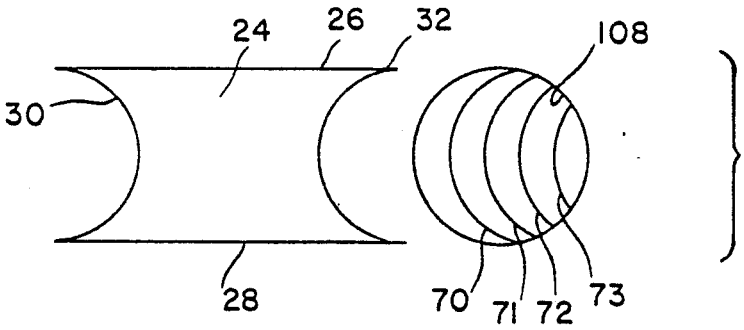
FIG. 12A is a top view illustrating the opening of the inlet port of a cylinder utilizing applicant's improved spherical rotary valve assembly.
Figure 12B:
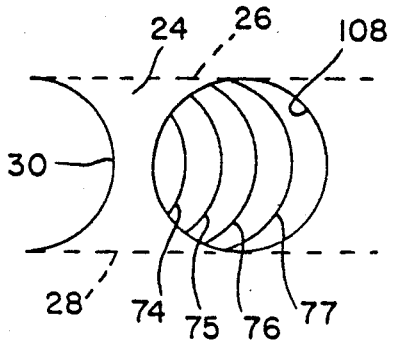
FIG. 12B is a top view illustrating the closing of the inlet port of a cylinder utilizing applicant's improved spherical rotary valve assembly.

FIGS. 12A, 12B, 12C and 12D illustrate the opening and closing of an inlet port 108 associated with a cylinder cavity 102 through the use of Applicant's improved spherical rotary valve having an elongated aperture as shown in FIGS. 12A and 12B and a spherical rotary valve which would have an aperture substantially coincidental with inlet port 108. The following explanation will be described with respect to a spherical rotary intake valve 10, but would have equal application to the operation of a spherical rotary exhaust valve 50. In FIG. 12A, aperture 24, which would be positioned on the spherical periphery 12 of spherical intake valve 10 would be in rotational translation with inlet port 108. Leading lateral end 32 of aperture 24 in spherical periphery 12 would engage inlet port 108 similar to the manner shown in FIG. 11A. Thereafter, as leading lateral edge 32 of aperture 24 rotationally passes across inlet port 108, the inlet port is opened in successive stages as shown by the positioning of leading lateral edge 32 at position 70, 71, 72 and 73. Immediately after position 73, the entirety of inlet port 108 would be opened, since its diameter would be substantially equal to the distance between longitudinal edges 26 and 28 of aperture 24.

FIG. 12B illustrates the closing of intake port 108. Trailing lateral edge 30 approaches inlet port 108 as the rotary intake spherical valve 10 continues its rotation. Trailing lateral edge 30 of aperture 24 commences the successive closing of inlet port 108 as shown at position 74, 75, 76 and 77. Shortly after position 77, inlet port 108 would be secured in a closed position by the spherical periphery 12 of spherical rotary intake valve 10.

Figure 12C:
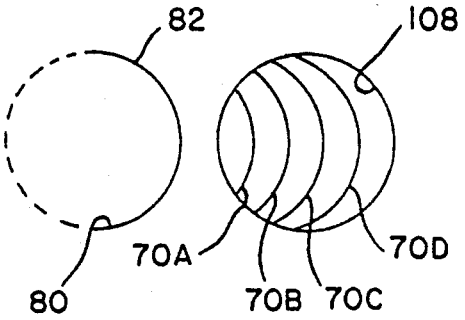
FIG. 12C is a top view illustrating the opening of an inlet port by means of a coincidental aperture in the spherical rotary valve.

FIG. 12C illustrates the opening of inlet port 108 by an optional aperture 80 positioned in spherical periphery 12 of spherical rotary intake valve 10, aperture 80 being substantially circular and coincidental with inlet port 108. The leading semi-circular edge 82 of aperture 80 would rotate into position with inlet port 108 and successively open inlet port 108 as illustrated by position 70A, 70B, 70C and 70D.

Figure 12D:
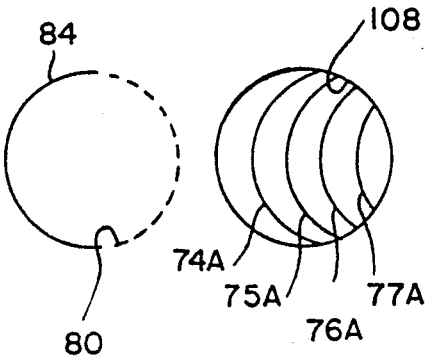
FIG. 12D is a top view illustrating the closing of an inlet port by means of a coincidental aperture in the spherical rotary valve.

FIG. 12D illustrates the closing of inlet port 108 by aperture 80 with trailing edge 84 rotating so as to successively close inlet port 108 as shown by position 74A, 75A, 76A and 77A.

As stated, the description of FIGS. 12A through 12B has been with respect to an inlet port 108, however, the same application and results are obtained from aperture 64 on spherical rotary exhaust valve 50. The length and width of aperture 24 and aperture 64 are dictated by the size of the rotary valve drum, the diameter of the inlet or exhaust port, respectively, and the amount of time that one wishes to have the inlet port or exhaust port open. FIGS. 12A through 12D illustrate that Applicant's design permits quicker opening and a longer opening of the inlet port or exhaust port, respectively.

While the above matter describes and illustrates the preferred embodiment of the invention, it should be understood that the invention is not restricted solely to the described embodiments, but that it covers all modifications which would be apparent to one skilled in the art and which would fall within the scope and spirit of the invention.

I claim:

1. An improved rotary intake valve for use in a rotary valved internal combustion engine for cooperation with the inlet port of the cylinder of said internal combustion engine for the introduction of a fuel/air mixture into said cylinder, said improved rotary valve comprising:

a drum body of spherical section formed by two parallel planer sidewalls of a sphere disposed about a center thereof, thereby defining a spherically-shaped end wall and formed with a shaft receiving aperture, said drum body formed with a circular-shaped cavity in a sidewall thereof and a channel extending between said circularly-shaped cavity and at least one aperture formed in said spherically-shaped end wall, said aperture formed in said spherically-shaped end wall having longitudinally-disposed sidewalls substantially parallel to said planer sidewalls of said drum body, said end walls of said aperture formed in said spherically-shaped end wall comprised of opposing curvalinear, semi-circular shapes, the radius thereof equaling the radius of said inlet port of said cylinder.

2. The improved rotary intake valve as defined in claim 1 wherein said circularly-shaped cavity is U-shaped in cross section.

3. The improved rotary intake valve as defined in claim 1 wherein said parallel sidewalls of said aperture in said spherically-shaped end wall are spaced apart a distance equal to the diameter of said inlet port.

4. The improved rotary intake valve as defined in claim 1 wherein a plurality of apertures are disposed on said spherically-shaped end wall.

5. An improved rotary exhaust valve for use in a rotary valved internal combustion engine for cooperation with the exhaust port of the cylinder of said internal combustion engine for the evacuation of spent gases from said cylinder, said improved rotary exhaust valve comprising:

a drum body of spherical section formed by two parallel planer sidewalls of a sphere disposed about a center of said sphere thereby defining a spherically-shaped end wall; and formed with shaft receiving aperture, said drum body formed with a conduit extending between an aperture in said spherically-shaped end wall to an aperture in one of said planer sidewalls, said aperture in said spherically-shaped end wall having longitudinally-disposed sidewalls substantially parallel to said planer sidewalls of said drum body, said end walls of said aperture formed in said spherically-shaped end wall comprised of opposed, curvalinear, semi-circular shapes, the radius thereof equaling the radius of the outlet port of said cylinder.

6. The improved rotary intake valve as defined in claim 5 wherein said parallel sidewalls of said aperture in said spherically-shaped end wall are spaced apart a distance equal to the diameter of said outlet port.

7. The improved rotary intake valve as defined in claim 5 wherein a plurality of said apertures are disposed on said spherically-shaped end wall, each of said apertures in communication with a corresponding aperture in one of said planer sidewalls.

* * * * *